United States Patent [19]

Norman

[11] 4,023,576

[45] May 17, 1977

[54] CIGARETTE MOUTHPIECE FOR CONTROLLING FLOW

[75] Inventor: Vello Norman, Raleigh, N.C.

[73] Assignee: Liggett & Myers Incorporated, Durham, N.C.

[22] Filed: July 11, 1975

[21] Appl. No.: 594,978

Related U.S. Application Data

[63] Continuation-in-part of Ser. No. 417,800, Nov. 21, 1973, abandoned.

[52] U.S. Cl. ..... 131/10 A; 131/10.5; 131/210

[51] Int. Cl.[2] ..... A24F 7/04

[58] Field of Search ..... 131/10 A, 10 R, 198 A, 131/10.5, 10.7, 261 B, 210, 201, 202, 10.9

[56] References Cited

UNITED STATES PATENTS

| | | | |
|---|---|---|---|
| 3,062,220 | 11/1962 | Brothers | 131/261 B |
| 3,490,461 | 1/1970 | Osmalov et al. | 13/10 A X |
| 3,601,133 | 8/1971 | Van Eck et al. | 131/210 X |
| 3,667,481 | 6/1972 | Thomas | 131/201 X |
| 3,789,855 | 2/1974 | Norman | 131/10 A X |

FOREIGN PATENTS OR APPLICATIONS

| | | | |
|---|---|---|---|
| 2,127,926 | 12/1972 | Germany | 131/261 B |
| 2,107,850 | 9/1971 | Germany | 131/10 A |

*Primary Examiner*—John F. Pitrelli
*Attorney, Agent, or Firm*—Michael L. Hendershot; J. Bowen Ross, Jr.

[57] ABSTRACT

The cigarette mouthpiece is made of one-piece construction in which two semi-cylindrical shells are hinged together along one edge and are releaseably secured together at the free edges. The mouthpiece has an internal cylindrical smoke chamber which is separated from a tobacco column at one end by a baffle means while the opposite end of the smoke chamber is defined by a pair of abutting walls which are each slotted to define an orifice. The orifice is of a predetermined diameter less than the diameter of the smoke passage to control the amount of smoke flowing out of the smoke passage for a given draw. The exterior surface of the mouthpiece is provided with longitudinal grooves which cooperate with an overlying perforated tipping paper to define flow paths for ventilation air. For a given draw, an amount of undiluted unfiltered smoke is drawn from the tobacco column into the smoke chamber and through the outlet orifice. At the same time, a quantity of ventilation air is drawn in through the tipping paper and longitudinal grooves to envelop the undiluted smoke within a smoker's mouth.

10 Claims, 6 Drawing Figures

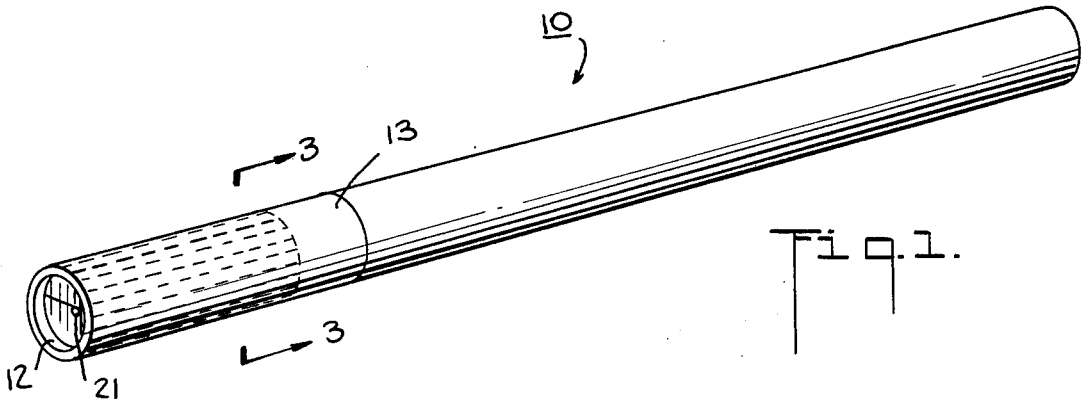
Fig. 1.
Fig. 2.
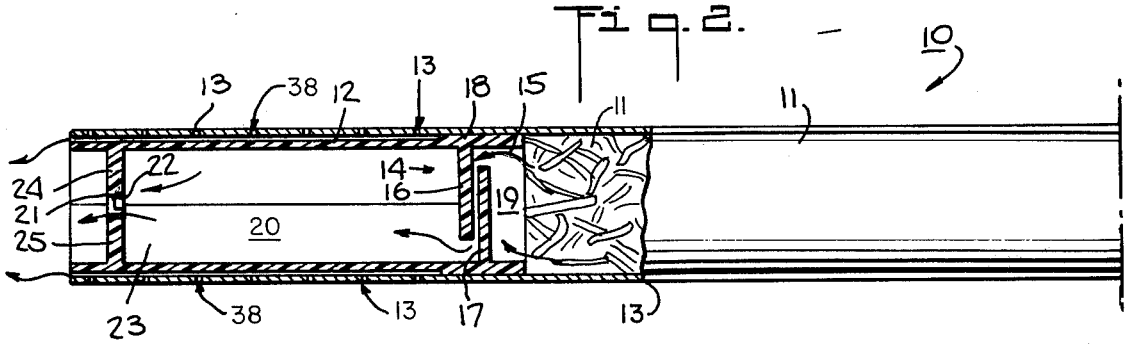
Fig. 4.
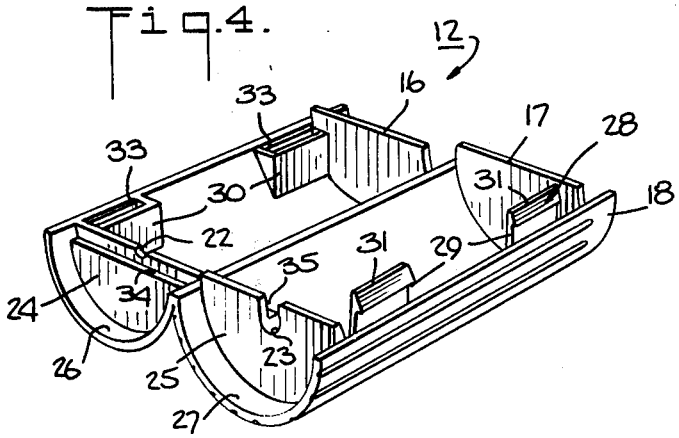
Fig. 3.
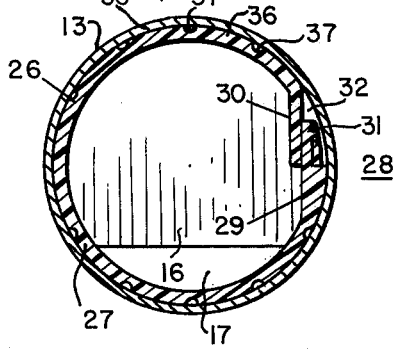
Fig. 5.
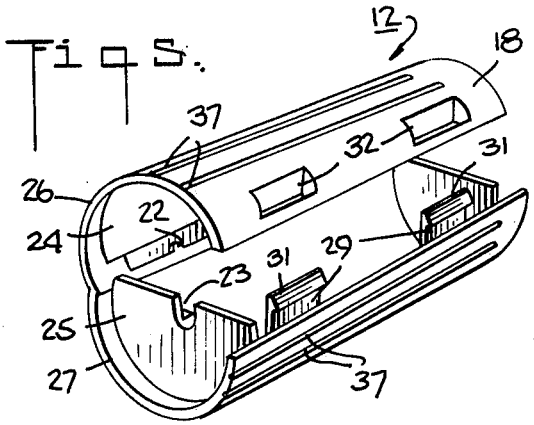
Fig. 6.
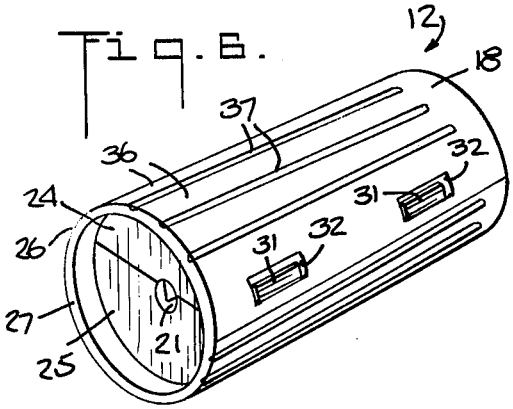

CIGARETTE MOUTHPIECE FOR CONTROLLING FLOW

This application is a continuation-in-part application of copending U.S. Patent Application Ser. No. 417,800, filed Nov. 21, 1973, now abandoned.

This invention relates to a mouthpiece and particularly to a mouthpiece for a cigarette. More particularly, this invention relates to a mounthpiece for controlling the flow of unfiltered undiluted smoke from a cigarette.

Heretofore, various types of mouthpieces have been utilized in the production of cigarettes. In some cases, the mouthpieces have been made as filters in order to filter out various substances from the smoke flow. For example, these filters have used materials such as a fibrous entrainment material to entrap solid particulate matter or adsorptive material such as charcoal to absorb various gases from the smoke flow. These materials have been used alone or in combination. In other cases, mouthpieces have been used not to filter but to pass a quantity of unfiltered smoke directly into a smoker's mouth. In these cases, the mouthpieces have frequently been provided with various types of ventilation openings which permit a quantity of ventilation air to dilute the unfiltered smoke prior to being drawn into a smoker's mouth. In still other cases, mouthpieces have been used to draw in ventilation air without diluting the smoke prior to being drawn into a smoker's mouth. However, the mouthpieces which have been devised for controlling the amount of smoke into a smoker's mouth have usually been of relatively complex construction. Because of this, it has been difficult to manufacture these mouthpieces in a simple manner and at relatively low cost.

It is known that the velocity at which the undiluted smoke impinges against the tongue of the smoker can vary the effective taste and flavor of the cigarette. At higher smoke flow velocities, the compact stream of undiluted smoke emerging from the orifice stays intact longer and is still in highly concentrated form when the stream impinges on the taste buds of the smoker. In the majority of previous ventilated mouthpiece constructions, the smoke stream and ventilating air, both flowing relatively slowly, mix readily within the mouthpiece or immediately after emerging from the cigarette and the smoke concentration is dissipated by the time the stream impinges on the smoker's taste buds.

Accordingly, it is an object of the invention to provide a simple mouthpiece construction for controlling smoke flow.

It is another object of the invention to provide a mouthpiece construction for a cigarette which accurately centers a smoke outlet.

It is another object of the invention to provide a mouthpiece for a cigarette which can be made at relatively low cost.

It is another object of the invention to provide a mouthpiece for a cigarette which can be easily modified to define different sizes of smoke orifice outlets.

It is another object of the invention to provide a self-supporting mouthpiece which can be easily incorporated into a cigarette.

It is another object of the invention to provide a mouthpiece for a cigarette which utilizes a minimum of materials.

Briefly, the invention provides a mouthpiece which comprises an internal smoke passage, means at one end defining a barrier to the passage of tobacco as well as a flow path for a flow of smoke passing into the smoke passage means defining, an orifice at the opposite end having a predetermined size to control i.e., meter the amount of smoke flowing out of the smoke passage for a given draw and means such as grooves on the exterior surface defining a plurality of flow paths for ventilation air. The mouthpiece is made of a one piece body construction of cylindrical shape and of substantially uniform diameter. In addition, the smoke passage is of cylindrical shape and is of uniform diameter throughout.

When used in a cigarette, the mouthpiece is abutted against a tobacco column and a strip of tipping paper is wrapped about the mouthpiece and tobacco column to secure the mouthpiece to the tobacco column. The strip of tipping paper is further perforated to cooperate with the grooves in the mouthpiece to supply ventilation air.

The means at the end of the mouthpiece which define a barrier to the passage of tobacco from the tobacco column into the smoke chamber may be of any suitable construction. For example, this means can be formed of a pair of longitudinally spaced baffles which are disposed in overlapping relation to each other.

The orifice at the opposite end of the mouthpiece is also defined by any suitable construction. For example, the orifice is defined by a pair of abutting walls disposed transversely to the longitudinal axis of the cigarette and by slots in each wall which are disposed in overlapping relationship to each other to define the orifice.

The grooves in the exterior surface of the mouthpiece can be formed by a plurality of raised longitudinally disposed ribs which extend to the outlet end of the mouthpiece. These ribs are positioned with respect to the perforations in the tipping paper to define the ventilation air flow paths.

The one piece body of the mouthpiece is formed from a pair of semi-cylindrical shells which are hingedly secured to each other along one longitudinal edge. The opposite free edges of the two shells have a releaseable means for securing the shells together. For example, the releaseable means is a tongue and slot type of construction. The baffles and the orifice defining walls are each formed in a respective half of the mouthpiece body in any suitable manner and are positioned so that when the two shells are brought together, the baffles and walls are disposed in proper disposition with respect to each other.

The mouthpiece is formed of any suitable material which is of a self-supporting nature. For example, the material may be made of a synthetic plastic material which can be easily molded. Thus, the mouthpiece can be molded in an open condition, that is, without the semi-cylindrical shells being folded over on each other. Further, the mouthpiece can be made in a batch-type of process in which a multiplicity of integrally connected mouthpieces are formed. The resulting structure can then be subsequently divided into the individual mouthpieces.

In order to facilitate the making of a filter cigrette, each mouthpiece has a smooth cylindrical surface at the end adjacent to the tobacco column which is of a diameter substantially equal to the tobacco column diameter. This surface acts somewhat as a collar to abut the tobacco column. Thus, the tipping paper can be wound around both the tobacco column and the mouthpiece without the formation of an apparent seam. In addition, the longitudinal ribs defining the ventilation air grooves extend from the edge of the cylindrical surface to the outlet end of the mouthpiece.

By forming the outlet orifice for the mouthpiece by the means of two slots in the edges of two abutting walls, the orifice can be easily centered on the longitudinal axis of the mouthpiece. Also, since there is little danger of the walls being crushed, the integrity of the orifice can be maintained throughout the life of the mouthpiece. In addition, the abutting walls can be provided with mating shoulders in order to assure a secure mating fit. In such a case, the slot in one wall can be made of semi-circular shape while the slot in the other wall is made of a U-shape to accommodate the shoulders. When the walls are brought together, the slots are overlapped with respect to each other to define a circular orifice or an orifice of oval shape.

These and other objects and advantages of the invention, will become more apparent from the following detailed description and appended claims taken in conjunction with the accompanying drawings in which:

FIG. 1 illustrates a perspective view of a cigarette incorporating a mouthpiece according to the invention;

FIG. 2 illustrates a fragmentary cross-section of the cigarette of FIG. 1;

FIG. 3 illustrates a view taken on line III-III of FIG. 1;

FIG. 4 illustrates a perspective view of a mouthpiece according to the invention in an opened condition;

FIG. 5 illustrates a view of a mouthpiece of FIG. 4 in a position prior to closing; and FIG. 6 illustrates a view of the mouthpiece of FIGS. 4 and 5 in a closed position.

Referring to FIG. 1, the cigarette 10 is made up of a tobacco column 11, a mouthpiece 12 and a strip of tipping paper 13 which secures the mouthpiece 12 to the tobacco column 11 in a conventional manner.

Referring to FIG. 2, the mouthpiece 12 is of cylindrical shape and of substantially uniform diameter throughout. The mouthpiece 12 includes a means 14 at the end adjacent to the tobacco column which serves as a barrier to keep any loose tobacco particles from entering the mouthpiece as well as defining a serpentine flow path for a flow 15 of smoke from the tobacco column 11. This means 14 comprises a pair of spaced apart baffles 16, 17 which are disposed in overlapping relation to each other. The baffles 16, 17 are sufficiently far apart to not impose a restriction on smoke flow. As shown, the mouthpiece 12 has a smooth cylindrical surface 18 in the plane of the baffles 16, 17 (i.e., concentric to the baffles 16, 17) which is of a diameter substantially equal to the diameter of the tobacco column 11. This surface 18 defines a collar which abuts the tobacco column 11. Thus, the tipping paper 13 which envelopes the tobacco column 11 and the mouthpiece 12 will not have any apparent joint at this point. The smooth cylindrical surface 18 and the baffles 16, 17 also define a recessed chamber 19 such that all the smoke emanating from the tobacco column 11 will be mixed t some extent before passing through the baffles 16, 17.

The mouthpiece 12 also has a smoke passage 20 of substantially cylindrical shape and uniform diameter throughout which extends from the baffles. In addition, an orifice 21 is provided in the mouthpiece 14 in a recessed end to communicate with the smoke passage 20. This orifice 21 has a predetermined orifice size less than the cross-sectional size of the smoke passage 20 in order to control the amount of smoke flowing out of the smoke passage 20 for a given draw. The orifice 21 is defined by means such as slots 22, 23 formed in a pair of abutting walls 24, 25. As shown, the walls 24, 25 are mounted to abut each other in the mouthpiece 14 and the orifice 21 is aligned with the longitudinal axis of the cigarette 10.

Referring to FIG. 4, the mouthpiece 12 is made up of a pair of semi-cylindrical shells 26, 27 which are each of semi-circular cross-section and which are hingedly secured in an integral manner to each other along a lingitudinal edge of each. The opposite free edges of the shells 26, 27 are provided with cooperating means 28 for securing the shells together in a closed cylindrical configuration as shown in FIG. 6.

Referring to FIGS. 4 and 5, the means 28 for securing the two shells 26, 27 together include a pair of projecting tabs 29 on one shell 27 and a pair of slot defining portions 30 on the other shell 26. The tabs 29 are each provided with a foot-like projection 31 at the ends which are tapered toward the free ends. These tabs 29 are each mounted to project from the inside surface of the shell 27 as shown in FIG. 3. The slot defining portions 30 are formed on the inside of the shell 26 to form a recess 32 in the exterior surface of the shell 26 and a slot 33 on the inside of the shell 26. The slots 33 are sized to receive the tabs 29 as shown in FIG. 6 when the shells 26, 27 are closed on each other while the foot-like projections 31 snap into interlocking relation with the portions 30 within the recesses 32.

As shown in FIG. 4, each shell 26, 27 carries a baffle 16, 17 at one end and a wall 24, 25 at the opposite end. As shown, the baffles 16, 17 are of generally semi-circular shape and project out of the plane of the shells 26, 27. In this way, when the mouthpiece 12 is in a closed position, as shown in FIG. 2, the baffles 16, 17 overlap each other.

As shown in FIG. 4, the wall 24 formed in one shell 26 is of a semi-circular shape and is flush with the edges of the shell 26. The other wall 25 is formed of a U-shape and projects from the plane of the other shell 27. Both walls 24, 25 have a shoulder 34, 35 which are sized to abut against the upper surfaces of the respective walls 24, 25 when the mouthpiece 12 is in a closed position. As shown, the walls 24, 25 are each formed integrally in a respective shell 26, 27 in alignment with each other. Thus, as the shells 26, 27 are brought together, the walls 24, 25 are also brought together in a mating fit.

The slot 22 formed in the wall 24 is of semi-circular shape whereas the slot 23 formed in the other wall 25 is of U-shape. These slots 22, 23 are oriented within the walls 24, 25 so that the slots 22, 23 overlap each other when the shells 26, 27 are brought together in interlocking relationship. Further, the slots 22, 23 are sized to form a circular orifice 21 when the walls 24, 25 abut. Alternatively, an oval shaped orifice can be formed by making the U-shaped slot 23 deeper.

Referring to FIGS. 3 and 6, the mouthpiece 12 is provided with a plurality of raised ribs 36 on the exterior surface which extend from the smooth cylindrical surface or collar 18 to the outlet end of the mouthpiece 12. These ribs 36 define longitudinal grooves 37 which, as shown in FIG. 2, cooperate with perforations 38 in the tipping paper 13 to define flow paths for ventilation air from the surrounding environment. The air is thus allowed to flow through the tipping paper 13 and grooves 37 out of the outlet end of the cigarette 10 for a given draw on the cigarette 10.

The mouthpiece 12 can be made of any suitable material such as a synthetic plastic material. Further, instead of being made of one piece, it is possible to make the mouthpiece of separate shells of similar construction as described above which can be interlocked together by suitable types of securing means.

Further, the mouthpiece can be formed in any suitable type of operation, for example, by a molding technique.

In use, when a smoker draws on the cigarette 10, smoke will be drawn from the tobacco column 11 into the recessed chamber 19 and thereafter through baffles 16, 17 into the smoke chamber 20 and thereafter through the orifice 21. However, the flow of smoke passing through the orifice 21 will be of relatively small cross-section compared to the size of the smoke chamber 20 and will also be at a high velocity compared to the velocity of flow in the smoke chamber 20. In addition, a quantity of air will be drawn in through the tipping paper perforations 38 and grooves 37 in the mouthpiece 12 to pass out of the cigarette 10 along with the stream of undiluted unfiltered smoke from the orifice 21. In this way, both smoke and air are drawn into a smoker's mouth for a given draw. The undiluted smoke will then impinge at a high velocity on the smoker's tongue in order to produce an enhanced taste. The air flow will serve to take up some of the smoker's puff volume and thereby reduce the total amount of smoke that the smoker receives. However, the air flow will not substantially dilute the concentration of the smoke stream prior to impingement on the tast buds.

The amount and velocity of the smoke flow and the air flow can be regulated by varying the respective draw resistances of the flow paths. Thus, the smoke yield of the cigarette can be varied over a wide range by a suitable combination of orifice size and size and number of tipping perforations. As shown in FIG. 2, the collar 18 serves to block off the entry of smoke into the grooves 37.

Typically, the orifice diameter is in the range from about 0.90 millimeters (mm) to 1.20 millimeters (mm) and the total area of the tipping perforations is in the range from about 1 square millimeter ($mm^2$) to about 4 square millimeters ($mm^2$). Appropriate combinations of values within these ranges result in cigarette dry particulate phase smoke ("tar") yield reductions in the range from about 20 to 80%. The effect on nicotine is generally somewhat less whereas gas phase constituents such as carbon monoxide and hydrogen cyanide are reduced more.

The materials from which the mouthpiece can be made include the following: polythylene, polypropylene, polyvinyl chloride, polyvinyl acetate, polystyrene and nylon.

What is claimed is:

1. A mouthpiece for a cigarette tobacco column comprising a one-piece body of cylindrical shape, said body being comprised of a pair of semi-cylindrical shells hingedly secured to each other along one longitudinal edge, said body including an internal smoke passage of predetermined cross-sectional size, means at the tobacco end of said body defining a barrier to the passage of tabacco from a tobacco column into said smoke passage, means defining an orifice at an opposite end of said body having a predetermined size less than said size of said smoke passage to meter the amount of smoke flowing out of said smoke passage for a given draw and to thereby deliver smoke at a higher velocity, said orifice defining means including a pair of abutting walls transverse to the longitudinal axis of said body, each of said walls having a slot therein disposed in overlapping relation to define said orifice, and means on an external surface of said body defining a plurality of flow paths for ventilation air, said flow path defining means comprising a plurality of grooves on the external surface extending to said orifice end of said body.

2. A mouthpiece as set forth in claim 1 wherein said shells include a releaseable means for securing said shells together along longitudinal edges opposite hinged longitudinal edge.

3. A mouthpiece as set forth in claim 1 wherein said barrier defining means at said tobacco column end includes a pair of longitudinally spaced apart baffles disposed in overlapping relation to each other.

4. A mouthpiece as set forth in claim 3 wherein said body has a substantially smooth outer cylindrical surface concentric to said baffles and said means on said exterior surface includes a plurality of longitudinal ribs extending from an edge of said opposite end of said surface.

5. A mouthpiece as set forth in claim 4 wherein said ribs terminate at a point interior of the tobacco column edge of said surface.

6. A mouthpiece as set forth in claim 1 wherein one of said abutting walls has a slot of U-shape and the other abutting wall has a slot of semi-circular shape.

7. A mouthpiece as set forth in claim 6 wherein each of said walls have a half-thickness shoulder and a lower base edge surface, said shoulders being sized so as to abut against the lower base edge surface of the respective walls when mouthpiece is closed.

8. A mouthpiece as set forth in claim 1 wherein said body is made of a synthetic plastic material.

9. A mouthpiece as set forth in claim 1 wherein said smoke passage is of cylindricl shape and of uniform diameter throughout.

10. A cigarette comprising a tobacco column of predetermined diameter, a one-piece body of cylindrical shape, said shape being comprised of a pair of semi-cylindrical shells hingedly secured to each other alone one longitudinal edge, said body including an internal smoke passage of predetermined cross-sectional size, means at the tobacco end of said body defining a barrier to the passage of tobacco from a tobacco column into said smoke passage, means defining an orifice at an opposite end of said body having a predetermined size less than said size of said smoke passage to meter the amount of smoke flowing out of said smoke passage for a given draw and to thereby deliver smoke at a higher velocity, said orifice defining means including a pair of abutting walls transverse to the longitudinal axis of said body, each of said walls having a slot therein disposed in overlapping relation to define said orifice, means on an external surface of said body defining a plurality of flow paths for ventilation air, said flow path defining means comprising a plurality of grooves on the external surface extending to said orifice end of said body, and a strip of tipping paper securing said mouthpiece to said tobacco column, said strip circumferentially covering said mouthpiece and having perforations communicating with said grooves to define a plurality of flow paths for ventilation air.

* * * * *